US005177903A

United States Patent [19]

Maier

[11] Patent Number: 5,177,903

[45] Date of Patent: Jan. 12, 1993

[54] METHOD AND APPARATUS FOR COPY-GRINDING AND FINISHING OF CYLINDRICAL AND SPHERICAL SURFACES

[75] Inventor: Urs Maier, Winterthur, Switzerland

[73] Assignee: Farros Blatter AG, Winterthur, Switzerland

[21] Appl. No.: 876,951

[22] Filed: May 5, 1992

Related U.S. Application Data

[63] Continuation of Ser. No. 407,295, Sep. 14, 1989, abandoned.

[30] Foreign Application Priority Data

Sep. 14, 1988 [DE] Fed. Rep. of Germany ..... 3831294

[51] Int. Cl.[5] ..... B24B 1/00

[52] U.S. Cl. ..... 51/165.77; 51/165.78; 51/165.8; 51/281 R; 51/328

[58] Field of Search ..... 51/165.75, 165 R, 165.77, 51/165.8, 140, 142, 143, 144, 145 R, 135 R, 135 BT, 141, 322, 328

[56] References Cited

U.S. PATENT DOCUMENTS

| | | | |
|---|---|---|---|
| 1,758,100 | 5/1930 | Andrews, Jr. . | |
| 2,162,044 | 6/1939 | Wilson . | |
| 3,165,865 | 1/1965 | Bousquet et al. . | |
| 4,075,791 | 2/1978 | Koide et al. | 51/142 |
| 4,112,628 | 9/1978 | Schmidt | 51/140 |
| 4,201,016 | 5/1980 | Kirk et al. . | |
| 4,219,974 | 9/1980 | Schmidt | 51/101 R |
| 4,382,727 | 5/1983 | Schmidt | 51/145 R |
| 4,488,382 | 12/1984 | Zajac | 51/145 R |
| 4,499,693 | 2/1985 | Fatula | 51/322 |
| 4,770,215 | 9/1988 | Hsieh | 51/145 R |
| 4,841,683 | 6/1989 | Williams | 51/142 |
| 4,930,259 | 6/1990 | Kobylenski | 51/89 |

FOREIGN PATENT DOCUMENTS

| | | |
|---|---|---|
| 560078 | 9/1932 | Fed. Rep. of Germany . |
| 3616260 | 2/1986 | Fed. Rep. of Germany . |
| 3639264 | 11/1986 | Fed. Rep. of Germany . |
| 2185918 | 8/1987 | United Kingdom . |

*Primary Examiner*—M. Rachuba

*Attorney, Agent, or Firm*—Burns, Doane, Swecker & Mathis

[57] ABSTRACT

A process that includes a precision grinding and subsequent finish grinding is preceded by an initial grinding phase in which a grinding belt that is pressed with predetermined pressure onto the outer surface of a preheated cylinder to be processed within a clearance X and X'. The clearance is adjustable by an adjusting device that adjusts the clearance between a guide rod and a contact roll in a manner such that a coating on the cylinder surface is uniformly removed independently of the surface gemoetry. Following the initial grinding, the pressure applied by the grinding belt is varied in a first grinding phase until a fixed connection between the guide rod and the contact is established. Such a method assures the uniform distribution of heat and thus the uniform expansion of the cylinder surface. Consequently, the cylinder can be machined with greater accuracy.

5 Claims, 4 Drawing Sheets

METHOD AND APPARATUS FOR COPY-GRINDING AND FINISHING OF CYLINDRICAL AND SPHERICAL SURFACES

This application is a continuation of application Ser. No. 407,295, filed Sep. 14, 1989, now abandoned.

FIELD OF THE INVENTION

The invention concerns a process and an apparatus for copy-grinding and finishing of cylindrical and spherical surfaces.

BACKGROUND OF THE INVENTION

In current disk grinding apparati, a cylindrical surface included for grinding is rolled over a grinding disk that is controlled by a cam plate. However, due to the grinding disk resting with its edge on the cylindrical surface, the formation of ridges on the surface to be processed cannot be avoided. In fact, in a worst case situation, turning of the surface may be required, followed by equalizing and finish grinding which, in most cases, involves several time consuming working steps. In addition, the turning and subsequent grinding operations contribute to the wear of the cylinder, thus reducing the overall life of the cylinder to be processed. These subsequent operations are particularly difficult and expensive at the ends of the cylinder which have slightly convex edges and require special devices to achieve acceptable results.

It is further necessary to preheat the turning and grinding machines over long periods of time since the machines are not protected against the radiating heat of the heat cylinder.

An apparatus of this type is known from DE-OS 36 39 264. Here, between two brackets mounted on columns, a support and an adjustable guide rod acting as a guideway and having a form corresponding to the set value of the spherical surface accuracy are provided. On the guide rod and the support, a grinding belt device that includes a grinding belt drive, a feed slide with adjusting devices and axially displaceable guide bushings and a clamping device are located.

A disadvantage which generally prevails in the precision grinding of worn cylindrical surfaces is that, initially, the partial surfaces projecting from the cylindrical surface are removed. In the case of heated cylinders, different radiating conditions are created between the machined and unmachined surfaces which leads to different temperatures in the cylinder wall. Consequently, differential thermal expansions are caused in the machined and un-machined partial surfaces.

OBJECTS AND SUMMARY OF THE INVENTION

It is the object of the present invention to prevent such high expansion differences between the projecting and smooth work partial surfaces of the cylinder in order to obtain greater machining precision, reduce the amount of material removal and to shorten grinding times and thereby extend the life of the cylinder.

This object is attained by the present invention as set forth in the claims.

An advantage of the present invention is that the precision grinding and subsequent finish grinding phases of the process are preceded by a grinding phase wherein the grinding belt is pressed with a predetermined pressure against the outer surface of the cylinder within an adjustable clearance. The adjustable clearance is between a guide rod and a contact roll so that the cylindrical surface is processed uniformly regardless of its geometry. The present invention assures a uniform heat distribution and thus a uniform expansion of the cylinder surface which is particularly important in the radial direction. In this manner, a cylinder geometry of a higher accuracy is obtained. In addition, the advantages of shorter grinding times with less material removal are obtained, which increases the life of the machined cylinders and reduces the amount of the grinding belt materials needed.

In the apparatus, the usual infeeds of the grinding belts relative to the cylinder surface are supplemented by a clearance movement X and X' which is adjustable between the guide rod and the contact roll by an adjusting mechanism wherein, preferably a $X/2=X'/2$ setting is established.

The support is shielded with a special heat plate relative to the cylinder surface to be machined such that deformations of the support are prevented and a higher processing precision of the cylinder to be machined can be obtained. Also, the time previously required for preheating of the grinding apparatus is eliminated.

BRIEF DESCRIPTION OF THE DRAWINGS

These objects are accomplished in accordance with a preferred embodiment which is illustrated in the accompanying drawings wherein the numbers refer to like items, and in which.

Figure 1:
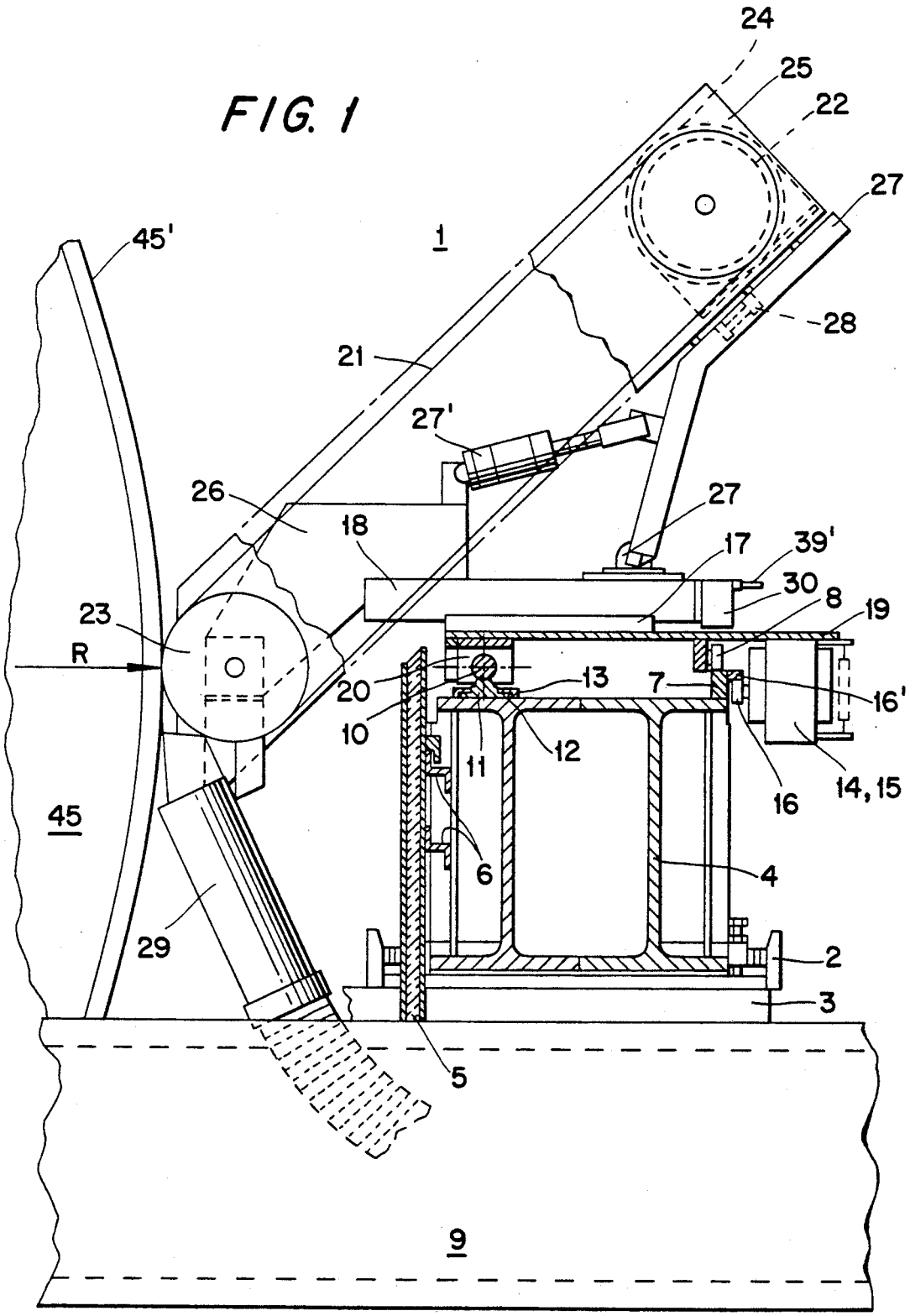
FIG. 1 is a view of the apparatus according to a preferred embodiment of the invention.
Figure 2:
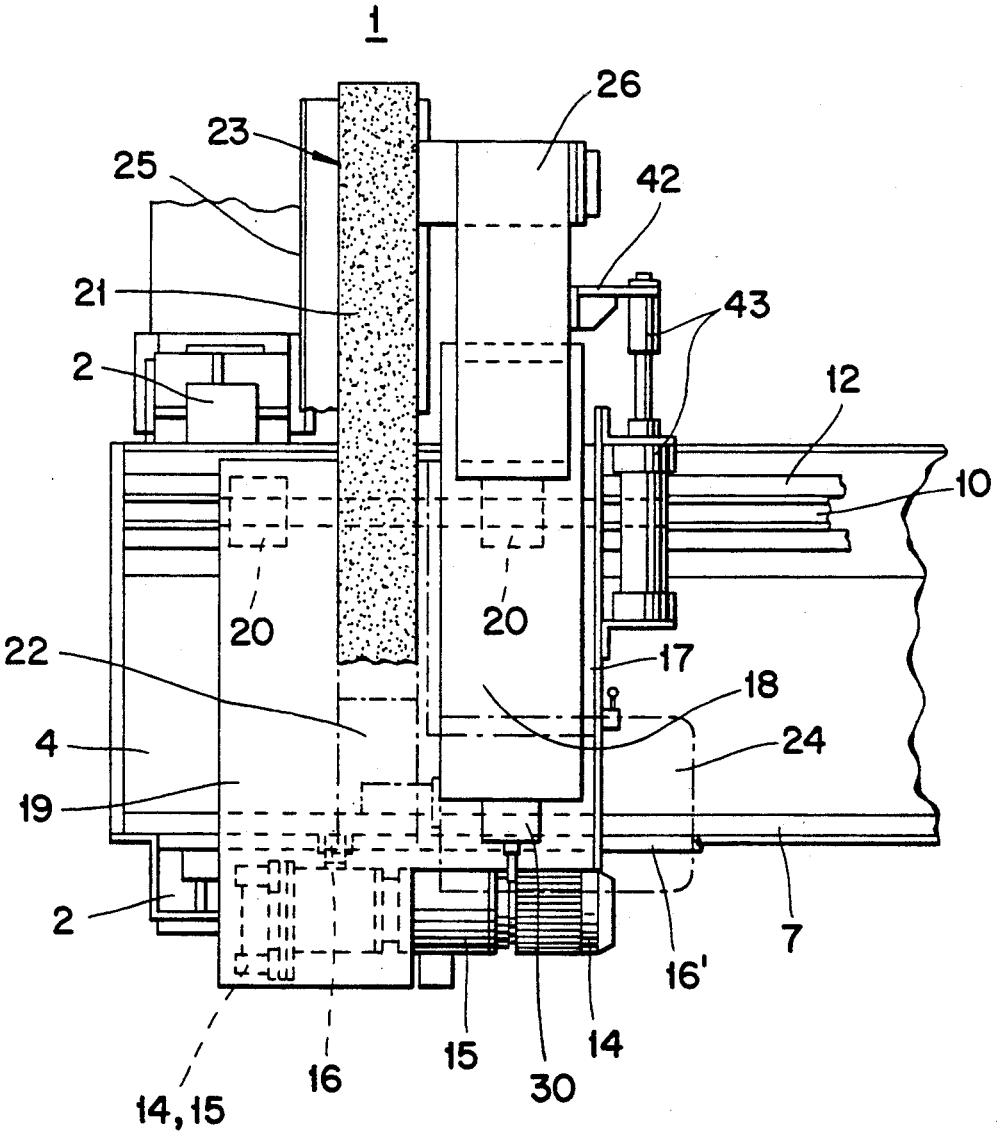
FIG. 2 is a top elevation of the apparatus according to FIG. 1.

According to FIGS. 1 and 2, a machine stand 9 is shown on which brackets 2 are provided to secure a support 4 onto a base plate 3. Disposed on the support 4 are a guideway 7 that cooperates with a supporting roll 8 and a guide rod 10. Additionally disposed on support 4 is a plurality of stays 11 that, together with seats 12, are uniformly spaced apart from each other in a displaceable manner. The guide rod 10 is located in the stays 11 (seen in FIG. 2 in cross-section only). On both sides of each seat 12 are adjusting screws 13 (indicated by screw axes only) whereby the profiled plate 10 may be adjusted over its axial dimension in accordance with a predetermined set dimensions. The dimensions are set in relation to the spherical terminal parts of the cylinder such that the guide rod 10 conforms to a desired profile for the surface to be ground 45' over the entire length of the cylinder 45. The support 4 is shielded against the cylinder surface 45' to be ground by a thermal insulating plate 5.

On the guideway 78 is disposed a support plate 19 with a displaceable feed slide 18 which is slidable over a tilted idler 8. The support plate 19 carries the mobile guide bushings 20 and the guide bushings 20 are slidable on the guide rod 10. By means of a drive motor 14, a gear 15, a tooth gear 16', and a rack 16', the feed slide 18 is guided along the surface 45' to be ground. The feed slide 18 includes the drive motor 14, a drive roll 22 and a contact roll 23 for the grinding belt 21.

The self-centering feature of the guide bushings 20 insures that the contact roll 23 mounted on a variable holder 26 is at all times positioned tangentially to the cylinder surface 45 so that a surface without ridges can be ground. The variable holder 26 for the contact roll 23 is connected with the guide bushings 20 so that automatic adaptation of the guide rod 10 to the surface 45' to be ground is obtained in keeping with the given desired profile.

The running position of the grinding belt 21 equipped with a protective cover 25 is adjusted by means of an adjusting screw 28 of the clamping device 27. The clamping device 27 consists of a clamping cylinder, a motor rocker and a bearing located on the feed slide 18. The radial feed of the grinding belt contact roll 23 is effected by means of the feed slide 18 set by an adjusting device 30.

For the removal of the debris produced due to grinding, an exhaust apparatus 29 consisting of an exhaust nozzle, an intermediate piece and an exhaust hose is provided.

Figure 3:
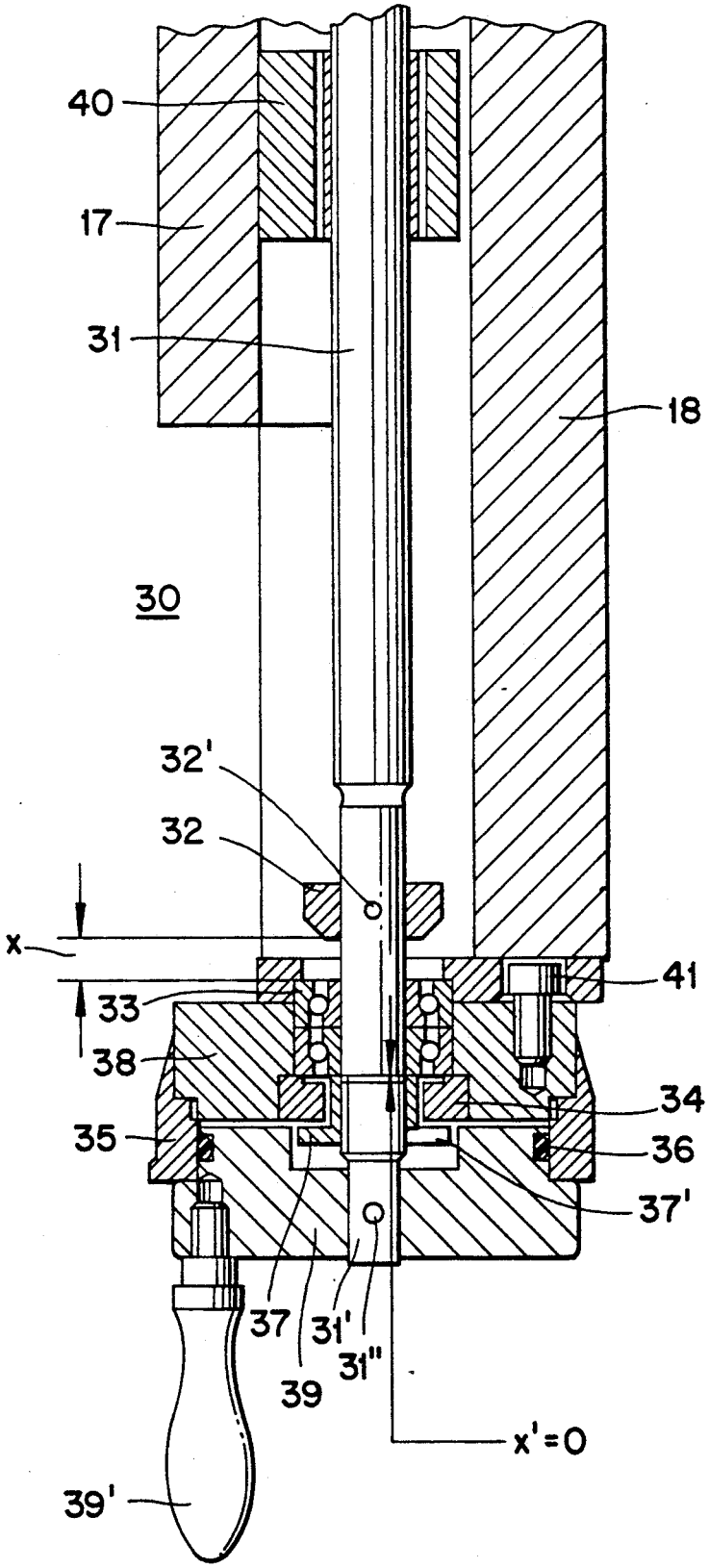
FIG. 3 is a longitudinal cross-section of an adjusting mechanism positioned in a first position and which is located on a feed slide of the apparatus according to FIGS. 1 and 2.

FIG. 3 shows the adjusting device 30 mounted by means of an intermediate piece 38 on the feed slide 18. A precision spindle 31 equipped with a variable stop ring 32 is provided wherein the spindle 31 is supported at one end in a spindle guide 40. The stop ring 32 is fastened to the spindle 31 by a fastening pin 32'. Spindle side 31', which faces away from the contact roll 23, is supported in bearings 33 and the bearings 33 may be tightened by means of a threaded clamp ring 34. The spindle 31 is secured in a sleeve 39 by a fastening pin 31''. To establish a fixed connection between the guide rod 10 and the contact roll 23, a ring 35 having a scale (not shown) is provided. The ring 34 abuts against the intermediate piece 38 of the adjusting device 30 and is entrained through a rubber ring 36 to a sleeve 39 which is equipped with a manual handle 39'. Through adjustment of the sleeve 39, it is possible to accurately set the contact roll 23 relative to the cylinder surface 45'. By overcoming the resistance of the rubber ring, the ring 35 usually may be set to the "zero" scale position. An angular threaded ring 37 for the setting of a clearance X and X' between the guide rod 10 and the contact roll 23 is threaded onto the precision spindle 31 below the threaded clamping ring 34. The threaded ring 37 is angled off toward spindle end 31' such that it abuts against the outer surface of the threaded clamping ring 34. The threaded ring 37 is secured to the spindle 31 by an adjusting screw 37'.

Figure 4:
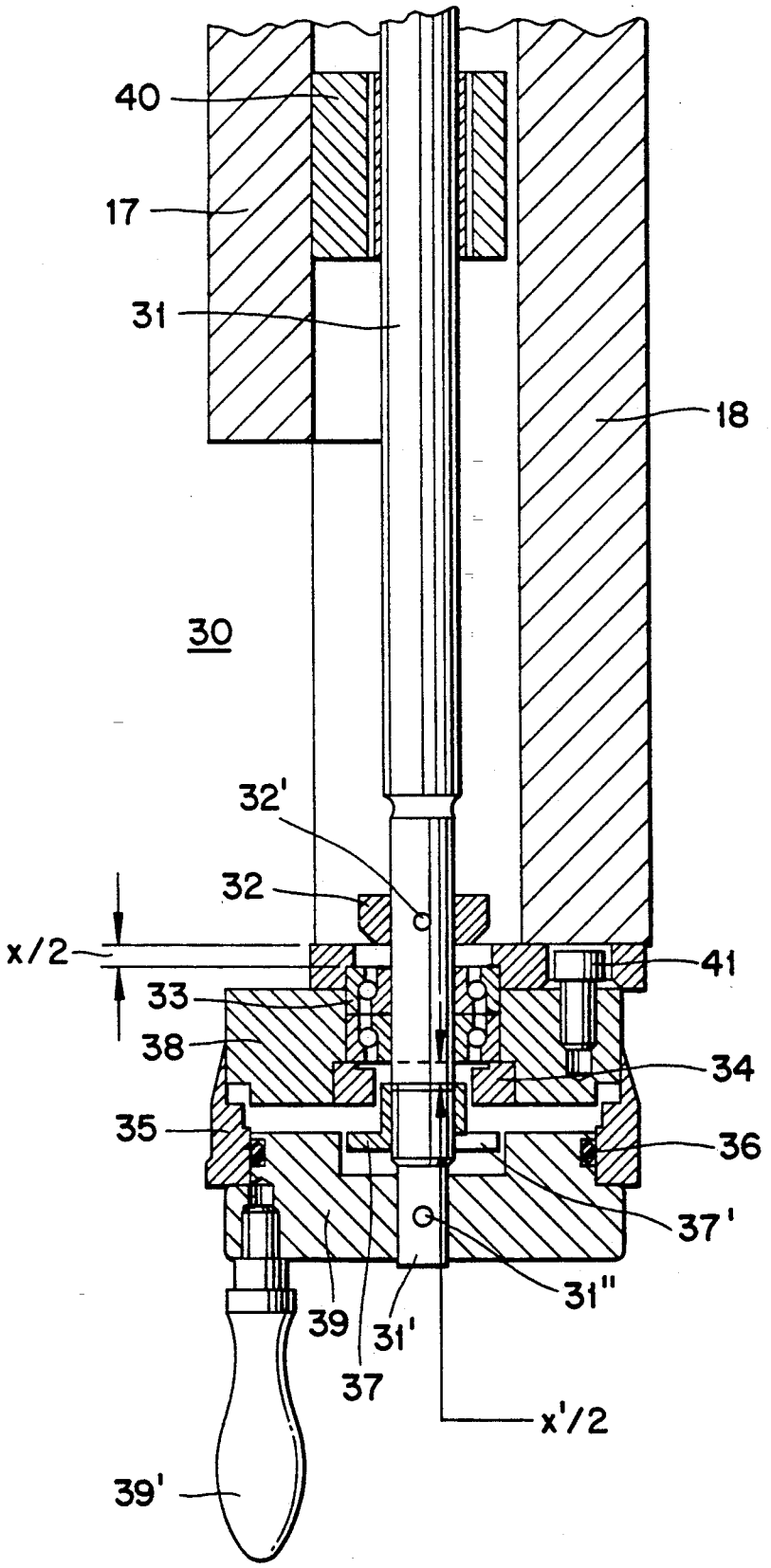
FIG. 4 is a longitudinal cross-section of an adjusting mechanism positioned in a second position and which is located on a feed slide of the apparatus according to FIGS. 1 and 2.

The threaded ring 37 shown in FIG. 3 forms a solid connection between the guide rod 10 and the contact roll 23 when a clearance $X'=0$. In order to form a connection between guide rod 10 and the contact roll 23 having a clearance X and X', the spindle 31 adjusted on relative to the spindle guide 40 such that a clearance is established between the threaded ring 37 and the bearings 33 as shown in FIG. 4. Simultaneously, a corresponding clearance is provided between the stop ring 32 and the bearings 33. To carry out the clearance movement X and X' of the spindle 31, a pressure mechanism 43 is fastened by a holder 42 to the feed slide 18. The mechanism 43 may be a pneumatic cylinder or a hydraulic cylinder or compression springs. Preferably, the pressure mechanism sets a clearance setting of $X/2=X'/2$ as shown by in FIG. 4.

The mode of operation of the invention is explained in more detail with reference to FIGS. 1 to 4.

The cylinder 45 to be machined, which may have undergone irregular surface wear and may contain surface coatings on the outer surface 45' of various particles such as resin, oil, paint residues or the like, is heated to a predetermined temperature and accelerated to a certain rotating velocity. Following the positioning of the grinding belt mechanism 1 in an initial setting that is a slight distance from the cylinder surface 45', a coarse grinding belt 21 is accelerated by means of a grinding belt drive 22, 23, 24 to a predetermined running velocity. In an initial grinding phase, the belt 21 is then pressed under a certain pressure to the outer surface 45' of the cylinder 45 to be processed in a manner such that the irregular cylinder surface 45' is uniformly removed. The uniform removal occurs independent of the surface geometry since a clearance X and X' is maintained between the guide rod 10 and the contact roll 23 by an adjusting device 30 as described in detail in the description relative to FIGS. 3 and 4. A pressure mechanism 43 such as a pneumatic cylinder, generates the clearance motion during grinding in the radial direction relative to the cylinder surface 45' of the contact roll 23.

The belt grinding apparatus 1 is axially displaced by a drive motor 14, 15 on the variable guide rod 10 in a manner such that the entire cylinder surface 45' is covered in overlapping grinding belt paths. As soon as the aforementioned surface layer has been ground off the cylinder surface 45', the conditions of the pressure acting on the grinding belt apparatus 1 are varied so that, in a subsequent grinding phase such as the precision grinding phase, a solid connection is established between the guide rod 10 and the contact roll 23. The connection is controlled by the variable feed slide 18 with the adjusting device 30, as already mentioned in the description relative to FIG. 3. The grinding belt apparatus 1 passes in a reciprocal motion in the axial direction over the entire length of the cylinder 45. After each pass, an appropriate adjustment of the contact roll 23 relative to the cylinder surface 45' is effected by the adjusting device 30. After the grinding belt 21 becomes worn out, it is replaced and the feed slide 18 is adjusted accordingly. The passes with the associated adjustments of the belt grinding apparatus 1 by the adjusting device 30 and the replacement of the grinding belt 21 is repeated until the cylinder 45 has attained the shape determined by the guide rod 10 in the axial direction along with the desired exact roundness. By the gradual uses of finer grinding belts 21, the grinding process is completed by a last grinding phase in which the exact and fine cylinder surface 45' required by the manufacturing process is obtained.

By means of the initial grinding phase wherein a clearance motion X and X' occurs in accordance with the irregularities of the cylinder surface 45' by the grinding belt 21 as pressed by the contact roll 23 radially against said surface 45', uniform heating and thus uniform expansion in the radial direction of the cylinder surface is obtained. As compared to known processes, higher operating accuracies, shorter grinding time, less material removal, and extended life times of the cylinder 45 are attained. Also, grinding belts are saved.

The apparatus according to the invention is preferably used without oil, i.e. as a dry-grinding apparatus. However, it is readily possible to carry out known wet-grinding processes also.

What is claimed is:

1. A method for the copy-grinding and finish-grinding a surface of a surface member to be ground by means of a belt grinding apparatus comprising the following steps:

heating the surface to be processed to a predetermined temperature, accelerating the surface to be processed to a predetermined rotating velocity, accelerating a grinding belt of a belt grinding apparatus to a predetermined running velocity, guiding a contact roller of said grinding belt into a first grinding position relative to the surface to be processed, said first grinding position being adjustable by a variable adjusting device, performing an initial grinding phase wherein said grinding belt passes in a reciprocating manner over an axial length of said surface to be ground and is pressed under a predetermined pressure onto said surface, said grinding belt being displaceable during said initial grinding phase relative to a guide rod having a desired surface profile, said grinding belt being displaceable within a predetermined clearance according to any irregular contour regions on said surface such that said surface is uniformly ground independently from an initial surface geometry, guiding said grinding belt into a second grinding position relative to the surface, wherein said grinding belt passes without clearance between said belt and said guide rod in a reciprocating manner in a direction parallel to said guide rod over an axial length of said member to be ground, performing a precision grinding phase by adjusting said contact roller of said grinding belt apparatus by a feed slide of said adjusting device after each pass in a grinding depth until said member to be ground attains a profile in accordance with the profile of said guide rod, and performing a second finish grinding phase wherein grinding belts of increasing fineness are used to obtain a desired member to be ground surface.

2. A method for copy-grinding as set forth in claim 1, wherein said contact roller is maintained in tangential contact against the surface by means of guide bushings, said guide bushings being self-centering.

3. A method for copy-grinding as set forth in claim 1, wherein said grinding is performed on a member to be ground having cylindrical end areas and a spherical middle area such that said surface is ground convexly at the end areas and cylindrically at the middle area.

4. A method for copy-grinding as set forth in claim 1, wherein said grinding is performed on a member to be ground having spherical end areas and a spherical middle area such that said surface is ground convexly at the end areas and the middle area.

5. A method for copy-grinding as set forth in claim 1, wherein said grinding is performed on a member to be ground having a cambered surface.

* * * * *